US005289649A

United States Patent [19]

Perez

[11] Patent Number: 5,289,649

[45] Date of Patent: Mar. 1, 1994

[54] PERPETUAL CALENDAR

[76] Inventor: Felipe P. Perez, 1917 #41 Col., Del Parque, Mexico, 15960

[21] Appl. No.: 833,815

[22] Filed: Feb. 10, 1992

Related U.S. Application Data

[63] Continuation of Ser. No. 556,749, Jul. 23, 1990, abandoned.

[30] Foreign Application Priority Data

Jan. 12, 1990 [MX] Mexico ..... 19108

[51] Int. Cl.[5] ..... G09D 3/08

[52] U.S. Cl. ..... 40/113; 40/115; 283/2

[58] Field of Search ..... 40/111, 113, 114, 115, 40/118; 283/2

[56] References Cited

U.S. PATENT DOCUMENTS 786,177 3/1905 Andrew ..... 40/113
1,692,758 11/1928 Nogrady ..... 40/115
2,116,288 5/1938 Schoenbaum ..... 40/115
2,191,757 2/1940 Hacker ..... 40/113
2,631,391 3/1953 Hanna ..... 40/113
2,815,596 12/1957 Russell ..... 40/115

OTHER PUBLICATIONS

Mechanica Popular (Popular Mechanics) (no date) (untranslated and translated).

*Primary Examiner*—Kenneth J. Dorner
*Assistant Examiner*—Brian K. Green
*Attorney, Agent, or Firm*—Heller & Kepler

[57] ABSTRACT

A perpetual calendar is disclosed which contains base and top members and a rotating disk member in between. The top member has two arcuate window openings, through one of which is seen the days of the month, and through the other of which is seen numerical indicia corresponding to a particular year desired. The back of the base member carries a key to the year indicia in matrix form which is accompanied by instructions for its use.

6 Claims, 4 Drawing Sheets

"CALENDARIO PERPETUO FPP."

Desde 1512 A.C. (Antes de Cristo) hasta el Año 4299 de nuestra Era.

INSTRUCCIONES.- Para encontrar el Calendario del Mes y Año deseado, se gira el disco hasta hacer coincidir el índice correspondiente a dicho Año con el Mes de que se trate. (Ene) y (Feb) se emplearán para Años Bisiestos.

El índice del Año deseado, se encuentra en el cruce de la columna de la Tabla B que contenga las 2 primeras cifras del Año, con el renglón de la Tabla A que contenga las 2 últimas cifras. Ej. El índice para 1990 es 0.

Para los Años Antes de Cristo y conforme al Calendario Juliano a1513 se le resta el Año deseado y con el residuo se procede como en el caso anterior.

Los Años Bisiestos se señalan en ROJO. También lo son los terminados en 00 del cómputo Juliano como 100, 200, etc., y 1600, 2000, 2400, . . ., 4000 del Cómputo Gregoriano.

13 14 11

TABLA B

| PARA EL COMPUTO | Dos primeras cifras del Año | | | | | | |
|---|---|---|---|---|---|---|---|
| JULIANO | | | | 00 | 01 | 02 | 03 |
| | 04 | 05 | 06 | 07 | 08 | 09 | 10 |
| | 11 | 12 | 13 | 14 | 15 | 16 | 17 |
| GREGORIANO | 15 | 1600 | | 17 | | 18 | |
| | 19 | 2000 | | 21 | | 22 | |
| | 23 | 2400 | | 25 | | 26 | |
| | 27 | 2800 | | 29 | | 30 | |
| | 31 | 3200 | | 33 | | 34 | |
| | 35 | 3600 | | 37 | | 38 | |
| | 39 | 4000 | | 41 | | 42 | |

10

TABLA A

| Dos últimas cifras del Año | | | | | | | | | | | | | | | | | | | | | | | | |
|---|---|---|---|---|---|---|---|---|---|---|---|---|---|---|---|---|---|---|---|---|---|---|---|---|
| 00 | 06 | | 17 | 23 | 28 | 34 | | 45 | 51 | 56 | 62 | | 73 | 79 | 84 | 90 | | 0 | 6 | 5 | 4 | 3 | 2 | 1 |
| 01 | 07 | 12 | 18 | | 29 | 35 | 40 | 46 | | 57 | 63 | 68 | 74 | | 85 | 91 | 96 | 1 | 0 | 6 | 5 | 4 | 3 | 2 |
| 02 | | 13 | 19 | 24 | 30 | | 41 | 47 | 52 | 58 | | 69 | 75 | 80 | 86 | | 97 | 2 | 1 | 0 | 6 | 5 | 4 | 3 |
| 03 | 08 | 14 | | 25 | 31 | 36 | 42 | | 53 | 59 | 64 | 70 | | 81 | 87 | 92 | 98 | 3 | 2 | 1 | 0 | 6 | 5 | 4 |
| | 09 | 15 | 20 | 26 | | 37 | 43 | 48 | 54 | | 65 | 71 | 76 | 82 | | 93 | 99 | 4 | 3 | 2 | 1 | 0 | 6 | 5 |
| 04 | 10 | | 21 | 27 | 32 | 38 | | 49 | 55 | 60 | 66 | | 77 | 83 | 88 | 94 | | 5 | 4 | 3 | 2 | 1 | 0 | 6 |
| 05 | 11 | 16 | 22 | | 33 | 39 | 44 | 50 | | 61 | 67 | 72 | 78 | | 89 | 95 | | 6 | 5 | 4 | 3 | 2 | 1 | 0 |

12

FIG.4.

PERPETUAL CALENDAR

This is a continuation of copending U.S. patent application Ser. No. 07/556,749 filed on Jul. 23, 1990, now abandoned.

This invention relates to a perpetual calendar, and more particularly a pocket calendar which uses a rotating disk to get the calendar of a month and year desired for a period extending over more than 5,000 years.

BACKGROUND OF THE INVENTION

Perpetual calendars existing until now either work only for a limited number of years, or require complicated instructions for their use. Instructions for using these calendars usually require various manual operations or mathematical computations to arrive at the month and year desired.

Accordingly, an object of the present invention is to provide a perpetual calendar which works for over 5,000 years.

Another object of the invention is to provide a perpetual calendar which is pocket-sized, so that it can be easily carried.

A further object of the invention is to provide a perpetual calendar which is easy to use with respect to manual and mathematical operations.

Another object of the invention is to provide a perpetual calendar by which one can determine the day of the week and month of a particular year quickly.

Still another object of the invention is to provide a perpetual calendar which can be printed on various materials and in various colors and designs to accommodate the needs of those who distribute them or use them for advertisement.

SUMMARY OF THE INVENTION

To achieve the foregoing and other objects of this invention there is provided a perpetual calendar from which for any desired year over a span of more than 5,000 years a monthly calendar can be obtained.

A key is provided on the back of a base member from which one obtains the indicia of the desired year. The year indicia is any numeral between and including "0" and "6." The key consists of three matrix-type tables. One obtains the desired year indicia by following instructions given to reach a cross point of the tables. The tables are constructed based on certain mathematical calculations.

A top member has two arcuate window openings. Through one window the year indicia can be read. Along this window the months are listed in columns in a radial fashion so as to align with a corresponding year indicia. There are seven columns, each containing from one to three months. The months are deliberately grouped in such a way as to provide the appropriate monthly calendars desired.

Through the other window the days of the month can be read. The numbers range from one to thirty-one to correspond to the maximum number of days in any particular month. The numbers are arranged in a radial fashion, yet give the appearance of a curved monthly calendar in which the days of the week and month are read from left to right. There are seven columns here as well, each corresponding to the days of the week, Monday through Sunday.

The days of the week are placed on the top member, outside of and along the widest part of the arcuate window opening. Each week day aligns with a column of days seen through the window.

In operation, once the year indicia is derived from the key, one turns over the calendar and places the year indicia over the month desired. This is done by a simple circular motion of a disk member placed in between the top and base members. Once the year indicia and the month are aligned, the correct monthly calendar will automatically appear through and along the other window opening.

BRIEF DESCRIPTION OF THE FIGURES

FIG. 4 is a partial view of the base member containing key indicia matrix tables representing the key indicia from which a desired year indicia is derived.

DETAILED DESCRIPTION

Figure 1:
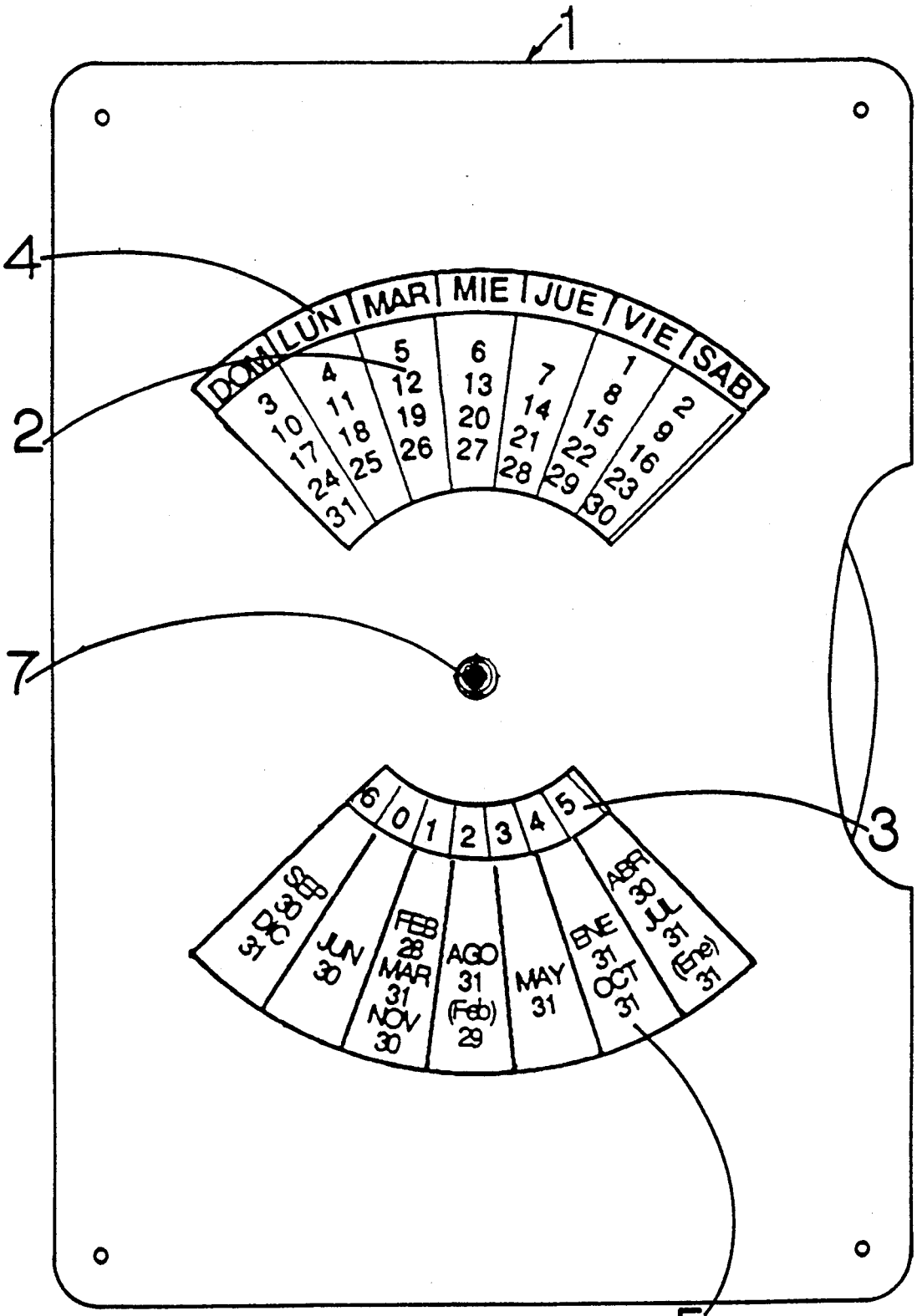
FIG. 1 is a top view of an embodiment of the present invention.
Figure 2:
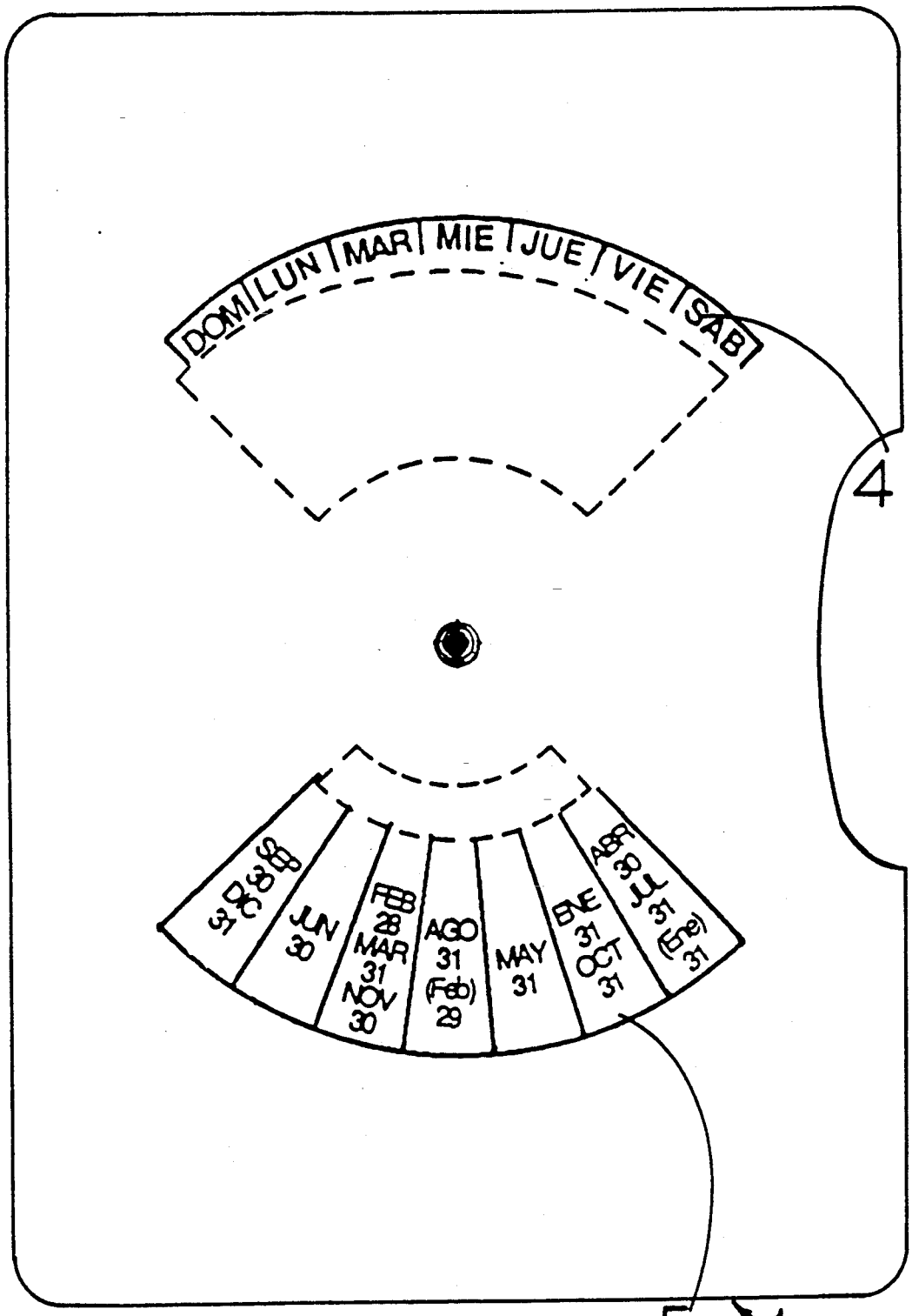
FIG. 2 a representation of the arcuate window openings with the days and months along the openings as they are in FIG. 1.

Referring now to FIGS. 1 and 2, there is provided a top member (FIG. 1), which has two windows 1. The windows allow one to see the days of the month 2 and the indicia 3 that correspond to the desired year. Over the top window the seven days of the week 4 are printed. Below the lower window are printed the months of the year 5.

Figure 3:
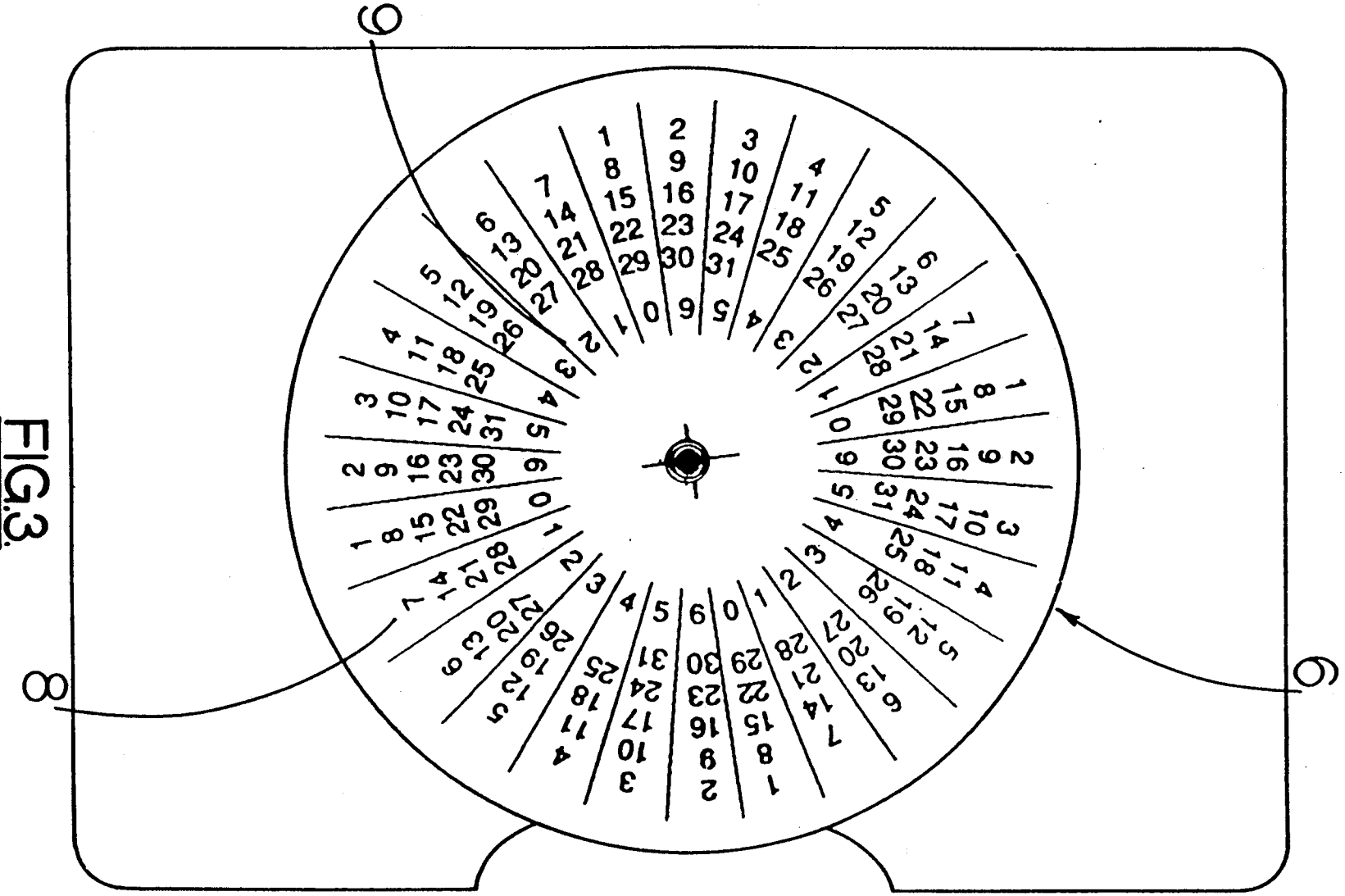
FIG. 3 is a view of the rotating disk member which is in between the top and base members.

Referring to FIG. 3, a disk 6 is shown that rotates on its own axis. The disk 6 is attached to the top member (FIG. 1) with a metallic eyelet 7. The disk 6 is printed with the days of the month 8 and the year indicia 9.

Referring to FIG. 4, tables "A" 10 and "B" 11 printed on a base member (FIG. 4) are illustrated. By using the tables 10 and 11, one finds the year indicia 3 corresponding to the desired year by using the year indicia matrix 12. One can also find a desired Julian year from the Julian year table 13 or Gregorian year from the Gregorian year table 14.

The calendar can be used for 5,811 years, from 1512 B.C. to 4299 A.C. For the Julian style, it can be used up to 1799 A.C. For the Gregorian style, it can be used from 1500 A.C. to 4299. The calendar can be expanded indefinitely by placing the first two numbers of the desired year in the rows corresponding to the Gregorian style 14.

The empty spaces on the top member (FIG. 1) can be used to print messages for advertisements and the like.

The perpetual calendar is operated by turning the disk 6 until the year indicia 3 corresponding to the desired year matches the month 5 desired. For leap years, one must match the year indicia with the "January" or "February" printed in red and in parentheses in the months 5, if January and/or February are the particular months desired for a leap year. It will be understood by one skilled in the art that these leap year months can be designated by other methods without departing from the spirit of the invention.

The year indicia 3 corresponding to the user's desired year is found in the cross point in the year indicia matrix 12 of the column of table B 11 that contains the first two numbers of the year with the row of table A 10 that contains the last two numbers of the year. For the years before Christ, to 1513 deduct the year wanted and with the remaining proceed as if the year was of the Julian style.

By way of example, the year indicia for 1990 is 0. To arrive at this, one finds the number "19" in the Gregorian section of table B 11. Then one finds the number "90" in table A 10. The cross point of the column in which "19" is found in table B 11 and the row in which "90" is found in table A 10 is the number "0" found in the year indicia matrix 12.

From the foregoing description, those skilled in the art will appreciate that all the objectives of the present invention are realized. A perpetual calendar had been provided which is pocket-sized and can be used quickly to achieve a monthly calendar for a particular month and year chosen from more than a 5,000 year span.

While specific. embodiments have been shown and described, many variations are possible. The particular design and style of the top, disk and base members, as well as the key matrix, days of the months and week, months and the year indicia, may vary without departing from the spirit of the invention.

Having described the invention in detail, those skilled in the art will appreciate that modifications may be made to the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A perpetual calendar, comprising:

a base member;

a top member joined to the base member, the top member defining a first window and a second window, the first window and second window both having arcuate openings;

a rotating disk having a center of rotation, the rotating disk supported for rotation about its center, intermediate the base member and the top member;

the first window having a first arcuate opening, such that sides of the first window lie along a first pair of spaced apart radial lines extending from the center of rotation of the rotating disk when the first window is in registration with a portion of a first disk indicia carried on the rotating disk corresponding to a calendar month, edges of the first arcuate opening of the first window in spaced apart relation between the first pair of spaced apart radial lines, the first window having a first edge margin opposite the center of rotation of the rotating disk, the first edge margin containing a first perimeter indicia representing the days of the week;

the second window having a second arcuate opening, such that sides of the second window lie along a second pair of spaced apart radial lines extending from the center of rotation of the rotating disk when the second window is in registration with a second disk indicia carried on the rotating disk corresponding to a year finding key number, edges of the second arcuate opening of the second window in spaced apart relation between the second pair of spaced apart radial lines, the second window having a second edge margin opposite the center of rotation of the rotating disk, the second edge margin containing a second perimeter indicia representing months of a year;

the first disk indicia on the rotating disk defining a plurality of monthly calendars arranged in a circle centered on the center of rotation of the rotating disk of thirty one days represented by the numbers 1 through 31 representing the days of the month, the first disk indicia visible through the first window in the top member, the first disk indicia of the rotating disk combining with the first perimeter indicia of the first window to create a thirty one day calendar in any location of the first window when the first window is in registration with the first disk indicia;

the second disk indicia on the rotating disk defining a series of year finding key numbers arranged in a circle centered on the center of rotation of the rotating disk corresponding to a year index, the series of year finding key numbers visible through the second window opening in the top member, the series of year finding key numbers combining with the second perimeter indicia of the second window to create the year index; and a matrix for use in obtaining a year finding key number by determining the intersection between a first table having the two last numbers of a year and a second table having the first two numbers of a year, whereby the combination of the year finding key number and the second perimeter indicia determine the second disk indicia revealed in the second window, which in cooperation with the first perimeter indicia and the first disk indicia revealed in the first window, is capable of providing monthly calendars for 5,812 years.

2. A perpetual calendar as set forth in claim 1 wherein the rotating disk further comprises a plurality of lines defining a plurality of equally spaced apart radial sectors extending outward from the center of rotation of the rotating disk and a plurality of series of numbers 1 through 31 individually located relative to the plurality of equally spaced apart radial sectors in a spiral pattern within their respective radial sectors.

3. A perpetual calendar as set forth in claim 1 wherein the base member carries a base member indicia, the base member indicia corresponding to a plurality of tables, the tables defining a plurality of intersection points, an intersection point providing the year finding key number to define the year index.

4. A method of determining a day for a particular month of a particular year, the method comprising the steps of:

providing a base member;

joining a top member to the base member;

defining a first window and a second window in the top member;

rotating a disk having a center of rotation, the rotating disk supported for rotation about its center relative to and intermediate of the base member and the top member;

defining the first window having a first arcuate opening, such that sides of the first window lie along a first pair of spaced apart radial lines extending from the center of rotation of the rotating disk, and at least two edges of the first arcuate opening of this first window in spaced apart relation between the first pair of spaced apart radial lines, the first window having a first edge margin opposite the center of rotation of the rotating disk, the first edge margin containing a first perimeter indicia representing the days of the week; defining the second window having a second arcuate opening, such that sides of the second window lie along a second pair of spaced apart radial lines extending from the center of rotation of the rotating disk, and at least two edges of the second arcuate opening of this second window in spaced apart relation between the second pair of spaced apart radial lines, the second window having a second edge margin opposite the center of rotation of the rotating disk, the second edge margin containing a second perimeter indicia representing months of a year;

defining a first disk indicia on the rotating disk as a matrix of thirty one days represented by the numbers 1 through 31, the matrix of thirty one days visible through the first window opening in the top member, the first disk indicia combining with the first perimeter indicia of the first window to create a thirty one day calendar in any location of the first window;

defining a second disk indicia on the rotating disk corresponding to a year index, the year index visible through the second window opening in the top member, the second disk indicia of the rotating disk combining with the second perimeter indicia of the second window to create the year index; and determining a year finding key number with the intersection between a first table representing the two last numbers of the year and a second table representing the two first numbers of the year, wherein the combination of the year finding key number and the second perimeter indicia determined the second disk indicia revealed in the second window, which in cooperation with the first perimeter indicia revealed in the first perimeter indicia and the first disk indicia revealed int he first window, correspond to a monthly calendar for a desired year, the year finding key number capable of providing monthly calendars for 5,812 years.

5. A method of determining a day as set forth in claim 4 further comprising the step of rotating the rotating disk to align a plurality of lines defining a plurality of equally spaced apart radial sectors extending outward from the center of rotation and a plurality of series of numbers 1 through 31 individually located relative to the radial sectors in a spiral pattern within their respective radial sectors.

6. A method of determining a day as set forth in claim 5 further comprising the steps of:

carrying the first table, the second table, and the year finding key number on the base member;

intersecting the first table and the second table for the desired year; determining the year finding key number; and aligning the rotating disk and the top member to display the monthly calendar for the desired year through the first window.

* * * * *

UNITED STATES PATENT AND TRADEMARK OFFICE

CERTIFICATE OF CORRECTION

PATENT NO. : 5,289,649

DATED : March 1, 1994

INVENTOR(S) : Felipe Perez, et. al.

It is certified that error appears in the above-indentified patent and that said Letters Patent is hereby corrected as shown below:

Column 6, Claim 4, line 3, after indicia, delete "revealed in the first perimeter indicia"--.

Column 6, Claim 4, line 5, change "int he" to --in the--.

Signed and Sealed this

Thirtieth Day of August, 1994

*Attest:*

Bruce Lehman

BRUCE LEHMAN

*Attesting Officer*

*Commissioner of Patents and Trademarks*